United States Patent [19]

Keller et al.

[11] Patent Number: 4,562,355

[45] Date of Patent: Dec. 31, 1985

[54] HIGH CURRENT ION SOURCE

[75] Inventors: Roderich Keller, Darmstadt; Fritz Nöhmayer, Frankfurt, both of Fed. Rep. of Germany

[73] Assignee: Gesellschaft für Schwerionenforschung mbH Darmstadt, Darmstadt, Fed. Rep. of Germany

[21] Appl. No.: 706,746

[22] Filed: Feb. 28, 1985

Related U.S. Application Data

[63] Continuation of Ser. No. 432,402, Sep. 30, 1982, abandoned.

[30] Foreign Application Priority Data

Dec. 18, 1981 [DE] Fed. Rep. of Germany ..... 3150156

[51] Int. Cl.[4] ..... H01J 27/00

[52] U.S. Cl. ..... 250/423 R; 313/355.1; 313/362.1

[58] Field of Search ..... 250/423 R, 425; 313/161, 359.1, 362.1, 363.1; 315/111.81

[56] References Cited

U.S. PATENT DOCUMENTS

| | | | |
|---|---|---|---|
| 2,782,337 | 2/1957 | Robinson | 250/423 |
| 2,824,967 | 2/1958 | Kumen | 250/425 |
| 3,371,489 | 5/1968 | Eckhardt | 313/362.1 |
| 3,603,089 | 9/1971 | Esker et al. | 313/161 |
| 3,705,320 | 12/1972 | Freeman | 250/423 R |
| 4,383,177 | 5/1983 | Keller et al. | 250/423 R |

*Primary Examiner*—Bruce C. Anderson

*Attorney, Agent, or Firm*—Spencer & Frank

[57] ABSTRACT

A high current ion source for generating ion beams from gases and non-volatile materials which comprises a furnace-cathode unit for generating vapor to be ionized, a major source unit for ionizing the vapor generated in the furnace-cathode chamber and an extraction unit for removing the ions from the major source unit. The three units are removably sealed to each other by vacuum-tight seals. The furnace-cathode unit includes a furnace chamber, the major source unit includes a discharge chamber and the extraction unit a source outlet electrode. Connecting means couple the furnace chamber to the discharge chamber, and suspension means are provided for suspending the components from surrounding flanges.

10 Claims, 7 Drawing Figures

HIGH CURRENT ION SOURCE

This is a continuation of application Ser. No. 432,402 filed Sept. 30th, 1982 abandoned.

BACKGROUND OF THE INVENTION

The present invention relates to a high current ion source and, in particular, to a source for generating ion beams from nonvolatile materials.

Radiation in the form of charged ions beams of about 10 to 100 mA current intensity are used for the operation of mass separators and ion implantation systems. In heavy ion accelerators, the final intensity can be increased if a high current source of singly or multiply charged ions is used, ions of nonvolatile elements and apparatus for their generation being of particular interest.

A mass separator source has been disclosed in the publication Ion Implantation, G. Dearnaley et al, North Holland Publ. Comp., Amsterdam (1973) pages 324–328, wherein a heated filament is arranged exactly in parallel with and at a predetermined distance from an extraction slit, the width of the extraction slit being correlated with the position of the filament. This apparatus permits the generation of ion currents up to 10 mA. However, it is disadvantageous in that the ion beam has a narrow rectangular cross section, the ion source burns quietly only within narrowly defined operating parameters and oscillations occur which destroy the space charge compensation of the ion beam and produce high divergence. Further, the plasma density cannot be adapted to a predetermined, freely selectable extraction geometry and the ion current cannot be increased by enlarging the extraction surface. Other disadvantages of the prior art mass separator source are that increasing the length of the slit requires a large heating filament which tends to warp during operation, the source body is made in part of graphite into which the charge material diffuses, the insulators are freely exposed to contamination by the generated vapor, the source must be built into a relatively large vacuum vessel and an external, homogenous magnetic field is necessary.

It is an object of the present invention to develop a high current ion source with which ion beams of high current intensities and predetermined beam cross-sections can be generated, and which can be adapted to predetermined operational requirements.

SUMMARY OF THE INVENTION

The present invention is a high current ion source for generating ion beams from gases and non-volatile materials which comprises a furnace-cathode unit for generating vapor to be ionized, a major source unit for ionizing the vapor generated in the furnace-cathode chamber and an extraction unit for removing the ions from the major source unit. The three units are connected to each other by vacuum-tight seals.

The furnace-cathode unit includes a furnace chamber, an elongated furnace pipe which extends axially from an opening in the furnace chamber and is supported by a bushing, an elongated cathode conductor extending axially from the bushing, an emitter heating means surrounding the cathode conductor, and suspension means for suspending the furnace, bushing and emitter heating means from surrounding flanges.

The major source unit includes an anode pipe surrounding the cathode conductor and defining a discharge chamber, annular reflector electrodes, an anode flange, a plurality of magnetic elements disposed within an annular chamber in the anode flange, suspension means for suspending the reflector electrodes from surrounding flanges and anode plates secured to the ends of the anode pipe and to opposite sides of the anode flange.

The extraction unit includes a source outlet electrode adjacent to the discharge chamber, an electron retarding electrode, and a ground electrode, and suspension means for suspending the outlet electrode from a surrounding flange.

Several advantages are realized with this high current ion source. Specifically, quiet ion beams of a predetermined cross-section can be generated from nonvolatile materials with very low emittance and divergence; several different types of materials can be used in the source; the radiation energy can be set within a range from about 5 to 100 keV and the radiation intensity in a range from about 1 to 100 mA; up to 50% doubly charged ions and up to 20% multiply charged ions can be generated; after heating, operation is possible without auxiliary gas; the effects of discharge, cathode and furnace power are decoupled from one another; operation is possible without a vacuum vessel and maintenance and adjustment of the apparatus are relatively simple.

With the high current ion source of this invention, it is possible to generate positive ions of substantially all elements whose vapor pressure at about 1500° C. is more than about 1 mbar. Elements having a lower vapor pressure can be introduced as volatile compounds in which case condensation of the desired element at the source walls is much inhibited, as compared to a cold source. Inert gases can be used in the source without difficulty. For use with volatile compounds or gases, only a thermionic cathode may be inserted into the major source unit, replacing the furnace-cathode chamber not necessary in these cases.

DESCRIPTION OF THE PREFERRED EMBODIMENT

Figure 1:
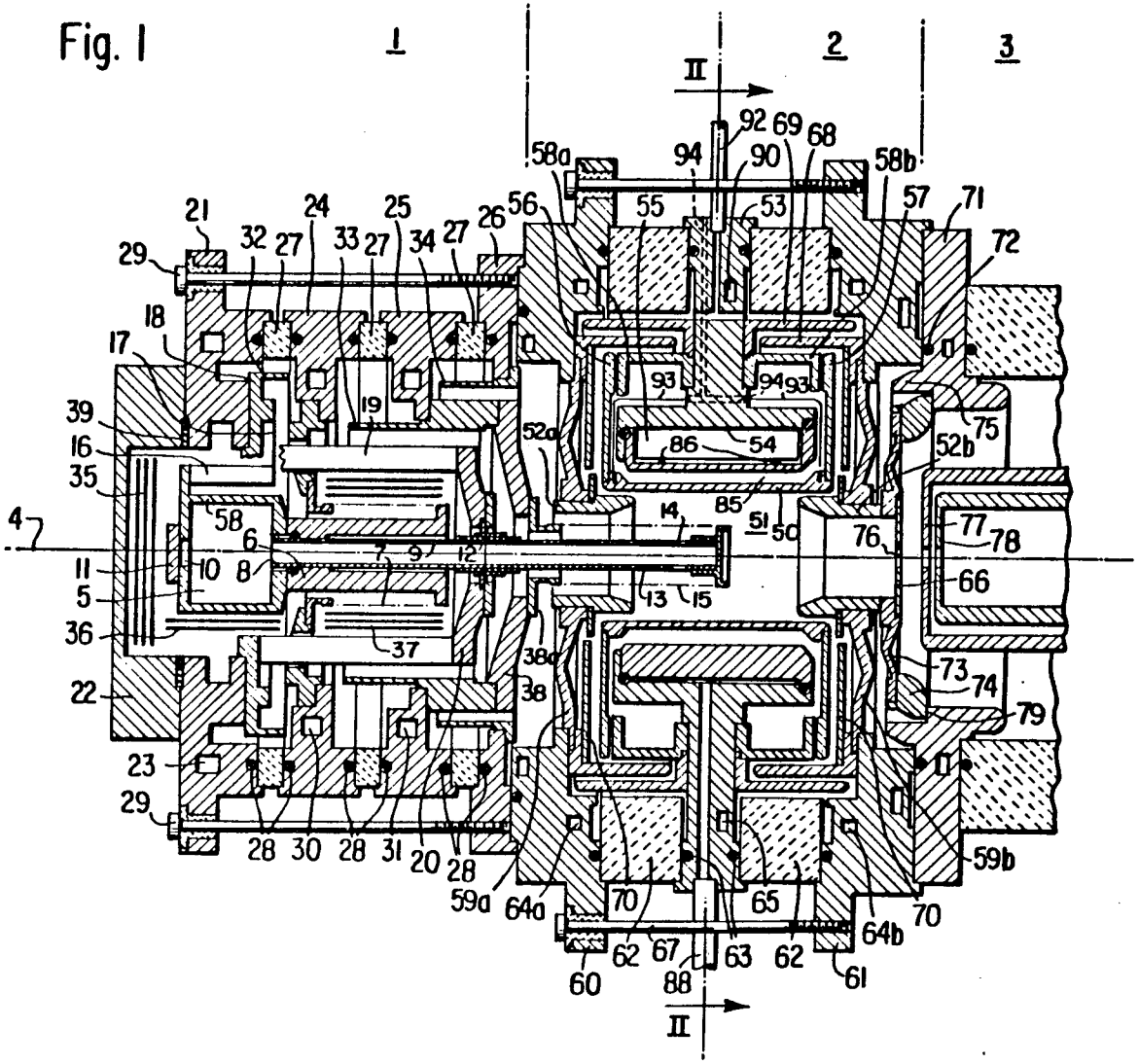
FIG. 1 is a simplified cross-sectional view of the high current ion source of this invention combining several planes of view.

A simplified axial sectional view of the high current ion source is shown in FIG. 1. The device includes three modules, a furnace-cathode unit 1 in which the vapor to be ionized is produced, a major source unit 2 which ionizes the vapor and an extraction unit 3 which removes the ions. The three modules, which have a common longitudinal axis 4, are connected together so as to be vacuum-tight. The furnace and cathode form one structural group whose components are mechanically connected together but are substantially decoupled from one another electrically and thermally.

At its side facing the major source unit 2, the cylindrical furnace chamber 5 is connected to a thick-walled sleeve 6 which is heated by heating conductors 7 surrounding the exterior of the sleeve and extending in the direction of the axis 4 so as to heat the furnace chamber by heat radiation and conduction. Helically wound wires or bands of tantalum or tungsten are used as the heating conductors 7.

The furnace chamber 5 has a bore 8 for accommodating a thin-walled elongated furnace pipe 9 that passes through the sleeve 6. The furnace also has an opening 10 disposed opposite the bore 8 in the direction of axis 4 for insertion of the substance to be evaporated, opening 10 being closable by means of a cover 11.

The furnace pipe 9 is attached to a pipe-shaped interior cathode conductor 13 by means of a bushing 12, cathode 13 having a free end provided with vapor outlet openings 14. A plurality of helically wound tantalum wires 15 positioned about the exterior of the inner cathode conductor 13 function as emitters.

The furnace chamber 5 is connected to a furnace supporting plate 18 by means of axially oriented bolts 16 and radial bands 17 connected to the ends of bolts 16. The bands 17 are elastic and compensate for changes in the lengths of all of the furnace parts which occur as they are heated. The bushing 12 which supports the furnace pipe 9 is connected to the furnace supporting plate 18 by axial stud bolts 19 and a bushing supporting plate 20. The furnace supporting plate 18 is secured to the inner side of a furnace flange 21, flange 21 being attached by a vacuum-tight connection at its outer side facing away from the furnace pipe 9 to a housing cover 22. The furnace flange 21 is provided with a cooling channel 23.

The furnace flange 21, a heating conductor flange 24, an emitter flange 25 and a connecting flange 26 are electrically insulated from each other by individual ceramic rings 27 and are connected together in a vacuum-tight hermetically sealed manner by O-rings 28. The furnace flange 21 and the connecting flange 26 are secured to each other by insulated bolts 29 disposed outside the heating conductor flange 24 and the emitter flange 25. The heating conductor flange 24 is provided with a cooling channel 30 and the emitter flange 25 is provided with a cooling channel 31. The ceramic rings 27 are protected against vapor condensation by vapor protection rings 32, 33, 34.

By suitably selecting the material and cross section for the spacer bolts 16 and bands 17 comprising the suspension for the furnace chamber 5, the furnace temperature can be adapted to different operating conditions of maximum available heating power input and required vapor pressure.

The temperature of the furnace is subject to one condition: the vapor pressure of the charge material at this temperature must meet the condition for forming a plasma within a discharge chamber 51 located in the major source unit 2, which chamber has the correct parameters such as ion composition and plasma density to match the applied extraction conditions such as the size of apertures 76 in a source outlet electrode 76 forming part of the extraction unit 3 and the electrostatic extraction field strength. The discharge chamber 51 and source outlet electrode 76 are described hereinafter in greater detail.

The exact temperature necessary cannot be predicted in advance, but an approximate value can be obtained by operating the source with a noble gas and measuring the gas pressure within the discharge chamber 51.

If the operational temperature is high (about 1000° C.) the problem is simple: the furnace suspensions should conduct as little heat as possible, the limit being set by the mechanical strength of the suspension components 16 and 17. In this case, stainless steel with its low specific heat conductivity and good mechanical strength is the best material for parts 16 and 17.

For the operation of the source with bismuth a furnace temperature of 990° C. is required, and four bolts of 6 mm o.d., a threaded axial bore of 3 mm i.d., and 25 mm length are employed together with four tapes 0.5 mm thick, 6 mm wide, and with 14 mm effective length. Assuming an average specific heat conductivity of 0.146 W $cm^{-1}K^{-1}$, there results a heat flow of only 60 W through the rods and bands. Thus, most of the furnace heating power, amounting to 2.32 kW in this specific case, is lost by heat radiation. If heat shields 35, 36, and 37 are used, this power can be reduced to 1.3 kW to reach the same temperature. Materials such as iodine, cesium and mercury, however, need only furnace temperature on the order of hundreds of degrees Centigrade. In this range, temperature control is difficult to obtain, due to the low power applied and the lack of instantaneous radiation cooling. The power conducted away by the suspensions in the above example would be 20 W approximately. In this case, the heat capacity of the furnace and its suspension would play an important role in source operation, inhibiting fast temperature control. It is then advantageous to employ bolts and suspensions made from copper which, for the same geometrical dimensions as the former example raise the heat power conducted away to about 500 W, thus facilitating temperature control. This effect can be further enhanced by increasing the band thickness or by installing eight bands and rods instead of four.

Heat losses due to radiation of heat from the furnace chamber 5 are reduced by heat shields 35 located in the housing cover 22, heat shields 36 disposed at the periphery of the furnace chamber 5 and heat shields 37 surrounding the heating conductors 7.

By suitable selection of the material, cross section and, if necessary, by electrochemical coating of the stud bolts 19, the temperature of the point of connection between the furnace pipe 9 and inner cathode conductor 13 can be set to a value above the furnace temperature and below the cathode temperature thereby allowing for loss-free vapor conduction and effective decoupling of furnace and cathode heating powers. This is achieved when the heat flow from the cathode through its inner conductor 13 towards the connecting point to the furnace pipe 9 is low as compared to the heat loss of the cathode by radiation, whereas the heat flow from the connecting point over the bushing 12, the plate 20, the bolts 19, and the supporting plate 20 towards the cooled flange 18 is just high enough to absorb most of the heat transported to the connecting point. In a realistic example where bismuth is used as the charge material, the temperatures of the cathode, connecting point and furnace are $T_1=2300°$, $T_2=1100°$ and $T_3=1000°$ C., respectively.

The heat flow equation then reads $$\alpha(T_1-T_2)=\beta(T_2-20^\circ\ C.)+\gamma(T_2-T_3),$$

where $\alpha=\lambda_c A_c/l_c$, the heat conductivity $\lambda_c$ of the cathode is 0.837 W $cm^{-1}$ $K^{-1}$, the area $A_c$ of the cathode is 0.206 $cm^2$ and the approximate length $l_c$ of a molybdenum cathode conductor is 5 cm;

$\beta=\lambda_b A_b/l_b$, the heat conductivity $\lambda_b$ of stainless steel bolts is 0.146 W $cm^{-1}$ $K^{-1}$, four bolts each having a diameter of 0.66 cm and a length of 6 cm provide a value of $\beta=0.0336$ W/K; and $\gamma=\lambda_f A_f/l_f$, the heat conductivity $\lambda_f$ of the furnace pipe 9 is 1.046 W $cm^{-1}$ $K^{-1}$, the area $A_f$ of the furnace pipe is 0.206 $cm^2$ and the approximate length $l_f$ of the pipe is 4.2 cm.

In reality, the connecting point under discussion is also heated by radiation, the amount of which is difficult to calculate. Its effect is that eight bolts of 0.8 cm diameter could be installed to keep the temperature of the connecting point about 100 K. above the furnace temperature. During the source test phase, the temperature of the connecting point should be recorded, and whenever it differs too much from the desired value it could be changed by modifications to the bolts. The electrochemical coating (with copper, for example), mentioned above, is a very easy and well controlled way to raise the heat conduction of the bolts without any mechanical change. Only thin layers of copper are necessary to give a great effect as its specific heat conductivity exceeds that of stainless steel by a factor of 20. If, on the other hand, the temperature of the connecting point is lower than the furnace temperature the bolt cross section can be reduced or the number of bolts decreased.

The bushing supporting plate 20 is designed with a comparatively large cross section because the bolts 19 are sufficient to control the heat flow, and their influence on the temperature is easier to estimate that calculate. In cases of a very high desired temperature, the cross section of plate 20 may also be reduced.

The bushing supporting plate 20, which serves as a suspension for the furnace pipe 9, and an emitter supporting plate 38 each have a cross section which is angled or bent in the direction of the axis 4 so that only axial movement is possible if there is a large drop in temperature. The emitter supporting plate 38 holds a ring shaped plate 38*a* made from molybdenum or tantalum which accommodates the tantalum wires of the emitter 15. Plate 38 fits on its outer side into protection ring 33 which is mounted on the cooled flange 25. On both plates, 20 and 38, there occurs a steep temperature decay as they are made from stainless steel, mostly for economic reasons. The bent cross sectional shape allows their inner zones to expand radially more than do the outer, cooler zones, still keeping the axial symmetry and at most causing a slight, axial movement of these inner zones which is accounted for by designing the free spaces between the inner source parts 6, 20, 38 and 52*a*. If plates 20 or 38 were completely flat the stronger expansion of their inner zones would cause an uncontrolled tilt against the axis of symmetry and even ruptures of the material. The tilt would result in radial movements of the inner components, with the danger of undesired short circuits of parts having different electrical potentials.

The vapor generated in the furnace chamber 5 is conducted through the furnace pipe 9 and the inner conductor 13 to the gas exit openings 14. The furnace chamber 5 is the coldest component and, therefore, condensate formation in the furnace pipe 9 and the inner cathode conductor 13 is prevented. The choke effect of the long pipes 9 and 13 which carry the vapor also reduces the effect of short-term pressure fluctuations in the furnace chamber 5. The furnace chamber 5 is charged with the material to be evaporated by removal of the housing cover 22, which is connected in a vacuum-tight manner to the furnace flange 21 by means of a metal seal 39, the first heat shield 35 and the cover 11. The charges are solid state materials which may be pure elements. The charges may also be alloys or mixtures if they are easier to obtain. The mechanical form may be dust or grains or other solid pieces. The only condition is that the vapor pressure exceeds 1 mbar at about 1500° C. Among such elements are: Li, Na, Mg, Al, P, S, K, Ca, Zn, Ga, Ge, As, Se, Rb, Sr, Cd, In, Sn, Sb, J, Cs, Ba, Hg, Tl, Pb and Bi. Extensive experiments have been performed with Ca and Bi.

The major source unit 2 includes the anode pipe 50 which surrounds the inner cathode conductor 13 and is coaxial therewith. Annular reflector electrodes 52*a* and 52*b* are disposed at the frontal end faces of the anode pipe and project into the discharge chamber 51. An anode flange 53, having a vacuum-tight annular chamber 54, completely encloses the anode pipe 50.

Permanent magnets 55 (see FIG. 2) are disposed within the annular chamber 54 so as to generate a linear multipole magnetic field in the discharge chamber 51. By separating the anode pipe 50 and the cooled annular chamber 54, it is possible to keep cool the temperature-sensitive permanent magnets 55 disposed in the annular chamber even though the temperature of the anode chamber 50 may be about 2000° C. Heat shields (not shown) may be placed between the anode pipe 50 and the annular chamber 54.

The ends of the anode pipe 50 are clamped between first and second radial planar anode plates 56 and 57. Each of the anode plates is screwed at its outer edge to a supporting ring 58*a*, 58*b* respectively which, at its inner side is connected with one of the outer sides of the anode flange 53. The axial lengths of the supporting rings 58 are selected so that the distance between the outer edge of the supporting ring 58*a* and the outer edge of the supporting ring 58*b* is less than the axial length of the anode pipe 50. Therefore, the holding plates 56 and 57 are deformed into very flat truncated cones. When during source operation their inner zones become hotter than the outer ones the deformation occurs exclusively in the direction of the axis 4 of the ion source. The effect is identical to that explained above for the plates 20 and 38. The difference is that the supporting plates 56 and 57 are originally fabricated from flat sheets (of stainless steel) and formed into truncated cones only by the mounting procedure.

After source operation, the dismounted plates 56 and 57 show that their inner zones are tilted against the outer zones. This means that a permanent expansion of the inner zones has taken place. When the plates are mounted once more into the source, however, the tilt vanishes showing that the conical deformation serves in the way intended.

Reflector electrodes 52*a* and 52*b* are centered in the bores of respective reflector plates 59*a* and 59*b* having cross sections which are bent in the axial direction. One of the reflector plates 59*a* is attached to an end flange 60 and the other reflector plate 59*b* to an end flange 61. The anode flange 53 is electrically insulated from the end flanges 60 and 61 by ceramic rings 62 and is connected in a vacuum-tight manner to rings 62 by O-rings 63. The end flanges 60 and 61 are provided with cooling channels 64*a* and 64*b*, and the anode flange 53 is provided with a cooling channel 65, the radii of cooling channels 64*a*, 64*b* and 65 being smaller than the radii of the O-rings 63. By this construction it is assured that the flange temperature near the O-rings does not exceed the temperature of the coolant.

By selecting the thickness and the material of the reflector plates 59*a*, 59*b* and of the first and second anode plate 56, 57, it is possible to match the temperatures of the anode pipe 50, the reflector electrodes 52*a*, 52*b* and a source discharge electrode 66 (which is part of the extraction unit 3) to the respective thermal output of the emitters 15 and to the discharge when different types of ions are used. This variability is very valuable as a detailed calculation of the different heat flows is very difficult and impractical. A zero order estimate starts with the input powers of 1.2 kW for the cathode, mostly radiated away, and 1 kW mean discharge power. Assuming equal partition between anode and both reflectors together, $P_a=1.1$ kW has to be transported away from the anode pipe 50 and $P_R=550$ W from each of the reflector electrodes 52*a*, 52*b*, the temperature difference being roughly 1200 K. Choosing stainless steel for all supporting plates, with $\lambda=0.146$ W $cm^{-1}K^{-1}$, we obtain $A_a/l_a=P_a/(\lambda\cdot\Delta T)=6.28$ cm and $A_R/l_R=P_R/(\lambda\Delta T)=3.14$ cm each. A is the middle circumference times the thickness of each plate and l the effective path length. For the existing source, plates 52*a*,*b* were made 0.5 cm thick, and plates 56, 57 were made 0.3 cm thick, yielding $A_R/l_R\approx 3$ cm and $A_a/l_a\approx 2$ cm, to obtain high enough temperatures which were confirmed by measurements. This very simple estimate gives an idea regarding the useful geometrical dimensions of plates 52*a*, *b* and 56, 57. Whenever the temperatures actually measured deviate too much from the desired values, the thickness of these plates should be changed depending upon whether the actual values are higher or lower. This will certainly be the case if (a) the plasma generation power, cathode power or duty factor are significantly different from the given example, or (b) the charge element has a vapor pressure curve much different from those of the Bi or Ca considered here. Of course, too high temperatures are only harmful if the melting point of the plate material is approached too closely. Then molybdenum instead of stainless steel is a good material choice or, as in the case of the bolts 19 (or 16) electrochemical plating of the plates with copper is an easy way to obtain higher heat conduction and thus lower temperatures. The previous discussion applies as well to the supporting plate 73 of the source outlet electrode 66. Only the plate thickness must be smaller since less power is expected to be deposited on this electrode because it is quite distant from the center of the discharge chamber 51.

Vapor protection rings 68 are connected by means of screws to the end flanges 60 and 61 and vapor protection rings 69 to the anode flange 53 in an overlapping manner to prevent condensation of vapor on the ceramic rings 62 thereby preventing electrical short circuits. Radiation absorbers 70 are disposed at the inner vapor protection rings 68 between the reflector plates 59*a*, 59*b* and the anode plates 56, 57 to absorb heat radiation from the anode plates if the anode pipe 50 reaches an excessive temperature, and conduct this heat to the cooled end flanges 60 and 61. Because of this feature, above about 1000° C., the temperature of the anode pipe 50 increases only slightly with an increase in the discharge power rather than increasing in proportion to the discharge power. Thus it is not necessary to tailor the thickness of the plates 52*a*,52*b* too exactly to the actual power present.

In the region of the furnace-cathode chamber 1, the ceramic rings 27 disposed between the furnace flange 21, the heating conductor flange 24, the emitter flange 25 and the connecting flange 26 are likewise protected by means of vapor protection rings 32, 33 and 34 against the condensation of vapor. The flanges 21, 24, 25 and 26 of the furnace-cathode chamber 1 and the flanges 60, 61 and 63 of the major source unit 2 are provided with external collars which accommodate the ceramic rings 27 and 62 respectively. This prevents bursting of the ceramic rings due to expansion of the flanges when they are heated.

The extraction unit 3 includes a source outlet electrode 66 which is maintained at a high positive potential, a ground electrode 78 at ground potential, and a retarding field electrode 77 at a negative potential which prevents electrons within the generated ion beam from being accelerated into the source. Vacuum sealing, electrical insulation and mechanical suspension of the ground electrode and retarding field electrode are conventional and are not part of the present invention.

The extraction unit 3 is provided with an extractor flange 71 which is connected in a vacuum-tight manner to the flange 61 of the major source unit 2 via an O-ring 72. A source outlet electrode 66 is disposed in the central bore of a circular ring-shaped holding disc 73 which has a cross section bent in the axial direction and is connected to the extractor flange 71 by a setting ring 74. The source outlet electrode 66 has extraction openings 76 for the ions generated in the discharge chamber 51, the openings being provided in the form of bores or slits in individual or multiple arrangements with predetermined cross-sections.

The exact dimensions and arrangement of the extraction openings are not part of the present invention. Generally, the extracted ion current varies proportionally to the total area of the openings. Single, circular openings yield ion beams of highest brightness but with limited current. But the aspect ratio, defined as the aperture radius divided by the distance between electrodes 66 and 77, is also limited to about 0.5 for beams with a moderate divergence of about 20 mrad half angle. Therefore, often multiaperture arrays are used when the desired current cannot be supplied by one aperture. Slits give the best open/total area ratio but cause higher divergence than circular holes. The essential feature of the present source is that it permits installation of plates, with any extraction pattern desired and also very easy exchange of different patterns if desired. (It should be noted that the theory of ion beam extraction is presently under development).

The source discharge electrode 66 must be aligned with great accuracy with the fixed retarding field electrode 77 and ground electrode 78. For this purpose, after the extractor flange 71 is mounted, the setting ring 74 which supports the holding disc 73 and the source outlet electrode 66 is adjusted radially by means of adjusting screws 75 and then fixed in its axial position by means of screws 79. The axial position of the source outlet electrode 66 can be changed by adjusting the positions of holding disc 73 and the setting ring 74. If necessary, the reflector electrode 52*b* may be connected directly to the holding disc 73 so that the reflector plate 59*b* is not needed. Precise alignment of the source discharge electrode 66 with respect to the ground and retarding electrode may be realized with the aid of fitting pins and may be controlled optically. The pins, having slightly smaller diameters than the outlet openings (0.02 mm less), are inserted into the openings in source outlet electrode 66 and the two extraction electrodes 77, 78 simultaneously. Then the outlet electrode is fixed to the flange 71. After fixing, the pins must still slide through the openings without exercising force. If they are blocked the screws 79 have to be loosened slightly and the position of the outlet electrode corrected by turning the screws 75.

If the openings are slits one can either use accurately machined sheets instead of the pins or control the alignment by inspecting outlet and extraction electrodes together with a telescope previously aligned to the axis of the beam transport system. This latter procedure is commonly used for the alignment of accelerator components in general.

After the source discharge electrode 66 is aligned, the major source unit 2 is screwed to the extractor flange 71. Because of the manner of fastening, the weight of the major source unit 2 does not influence the adjustment of the source discharge electrode 66. Finally, the furnace-cathode chamber 1 is screwed to the major source unit 2.

After removal of the housing cover 22, which is connected in a vacuum-tight manner to the furnace flange 21 by means of the metal seal 39, the first heat shield 35 and the cover 11, the furnace chamber 5 can be charged through opening 10. In order to start operation of the apparatus, the emitter 15 and the inner cathode conductor 13 are brought to operating temperature and a discharge is fired in an auxiliary gas introduced into the discharge chamber 51 through one or more of the four auxiliary gas conduits 92 connected to the circumference of the anode flange 53. As soon as the anode pipe 50, the inner cathode conductor 13, the reflector electrodes 52*a*, 52*b* and the source outlet electrode 66 are sufficiently hot, for example, about 1200° C., the furnace chamber 5 is heated. When the furnace temperature is sufficient (about 1000° C.) to evaporate the charge material, vapor passes through the furnace pipe 9 and the inner cathode conductor 13 into the discharge chamber 51. (The temperature values given apply to bismuth as the charge material.)

The vapor is ionized in the discharge chamber and replaces the auxiliary gas whose influx is choked off gradually. In certain cases, for example for the production of multiply charged ions, operation with an auxiliary gas component, particularly helium, may be of advantage. Either pulsed or direct current operation may be employed to obtain the discharge, the components enclosing the discharge chamber being adapted with respect to heat conductivity by matching their cross-sectional area to the expected power input applied. The ion source is switched off in the reverse sequence. In this way, condensation and tinsel formation at the ceramic rings 27, 62 is avoided which could interfere with a new start.

Figure 2:
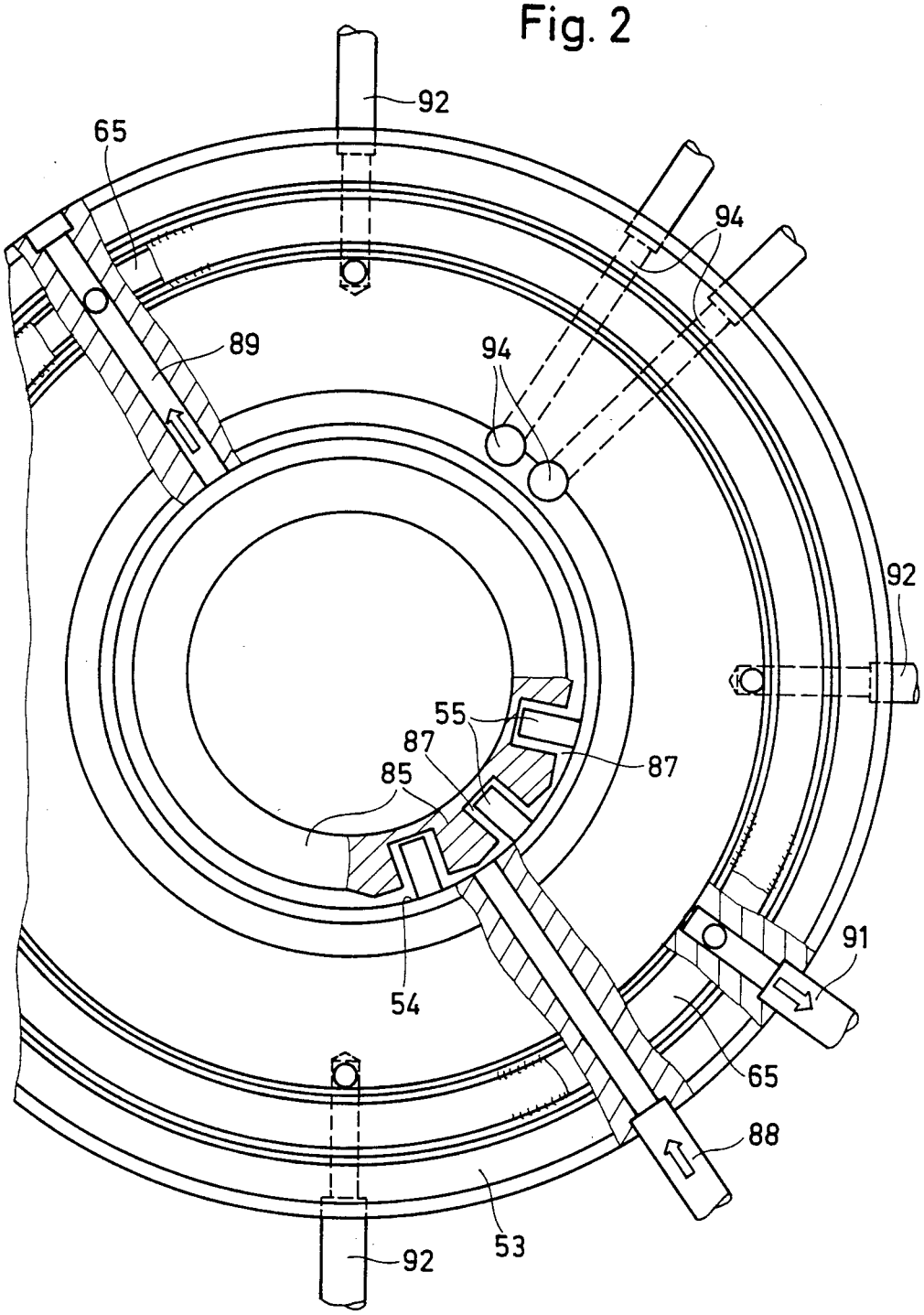
FIG. 2 is a simplified view of the anode flange of the apparatus of FIG. 1 taken along the line II—II.

FIG. 2 is a simplified representation of the side of the anode flange 53 with parts of the cross section broken out associated with the extraction unit 3 taken along the line II—II of FIG. 1. As shown, the permanent magnets 55 are uniformly distributed over the circumference of the annular chamber 54 and held within an annular magnet receptacle 85 having bars 86 (see FIG. 1) against the wall of the chamber 54. In this way, a meander-shaped magnet cooling channel 87 is formed along the circumference between the permanent magnets 55, the magnet receptacle 85 and the annular chamber 54. The magnet cooling channel 87 encloses each one of the permanent magnets 55 on the side facing the hot anode pipe 50 and on the adjacent radial sides.

The coolant, which may be an organic liquid like glycol and must not attack the chemically unstable cobalt/rare-earth permanent magnets, is introduced through a coolant inlet 88, through a bore in the anode flange 53 and into the magnet cooling channel 87. The coolant is then transported through an overflow channel 89 disposed in the anode flange 53 to the annular anode flange cooling channel 65 where it is discharged through a coolant discharge line 91. The auxiliary gas required in certain cases is conducted through one or more of the four auxiliary gas conduits92 connected to the circumference of the anode flange 53, through a radial bore and an axial bore into the discharge chamber 51 and then removed through extraction opening 76.

The temperature of the anode pipe 50 is monitored by means of jacket thermocouples 93 (see FIG. 1) which are each placed through one of a plurality of thermocouple bores 94 penetrating the anode flange 53 radially and axially and disposed adjacent each of the two reflector electrodes 52*a*, 52*b* at the exterior of the anode pipe 50. The thermocouples are embedded in a synthetic resin and cast into stainless steel tubes connected vacuum-tight to the anode flange 53.

Figure 3:
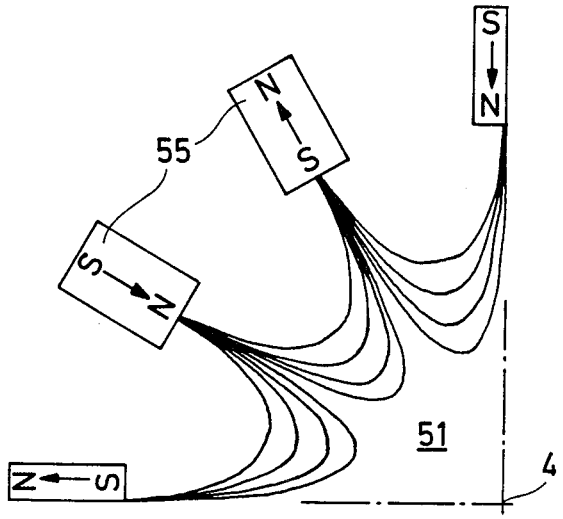
FIG. 3 illustrates the field configuration in the discharge area with radial polarization of the permanent magnets.
Figure 4:
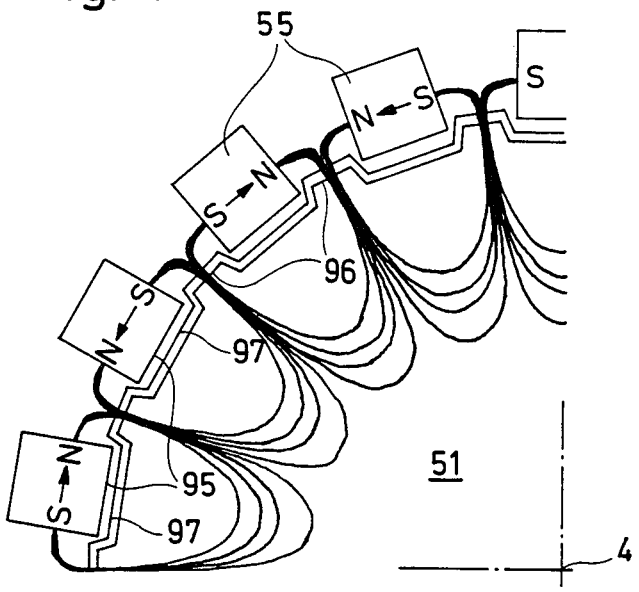
FIG. 4 is a diagram of the field configuration in the discharge area with tangential polarization of the permanent magnets.

FIG. 3 shows the field configuration existing in the discharge chamber 51 when the permanent magnets 55 are magnetized radially as in FIG. 2, and FIG. 4 shows the field of configuration when the permanent magnets 55 are magnetized tangentially. The paths of those field lines wich run at the exterior of the circular ring of the permanent magnets 55 are not shown since they are of no significance in the operation of the ion source.

The tangential polarization of the permanent magnets 55, as shown in FIG. 4, results in a magnetic field pattern having the highest density of field lines at the center planes between adjacent magnets along a circular contour defined by the inner faces 95 of the magnets. Electrons, carrying the discharge power, can escape the plasma only where the magnetic field lines radially cross the anode wall 96 in FIG. 4 or 50 in FIG. 1. Thus the optimum plasma inclusion, and therefore least power loss or highest efficiency of the ion source, is realized if the wall 96 of the discharge chamber 51 passes precisely through these lines of highest field density.

This situation cannot be exactly realized when using the magnet arrangement of FIG. 3 because the lines of highest field density touch the magnet pole faces which, however, must be kept cool.

The arrangement of FIG. 4, on the other hand, permits placing the crossing lines at any desired radius, and especially at the radius of highest field density by giving the wall 96 a corrugated shape. (The radial width of the anode wall 96 is of no importance for the discharge whereever the magnetic field lines do not cross this wall radially).

Insertion of a second, vacuum tight, wall 97 at the exterior of wall 96 and parallel to it provides a means of cooling the magnets directly, placing the wall/field crossing lines at the most suitable radius and having the inner wall 96 run hot as a result of the power generated by the cathode radiation and discharge plasma losses.

Figure 5:
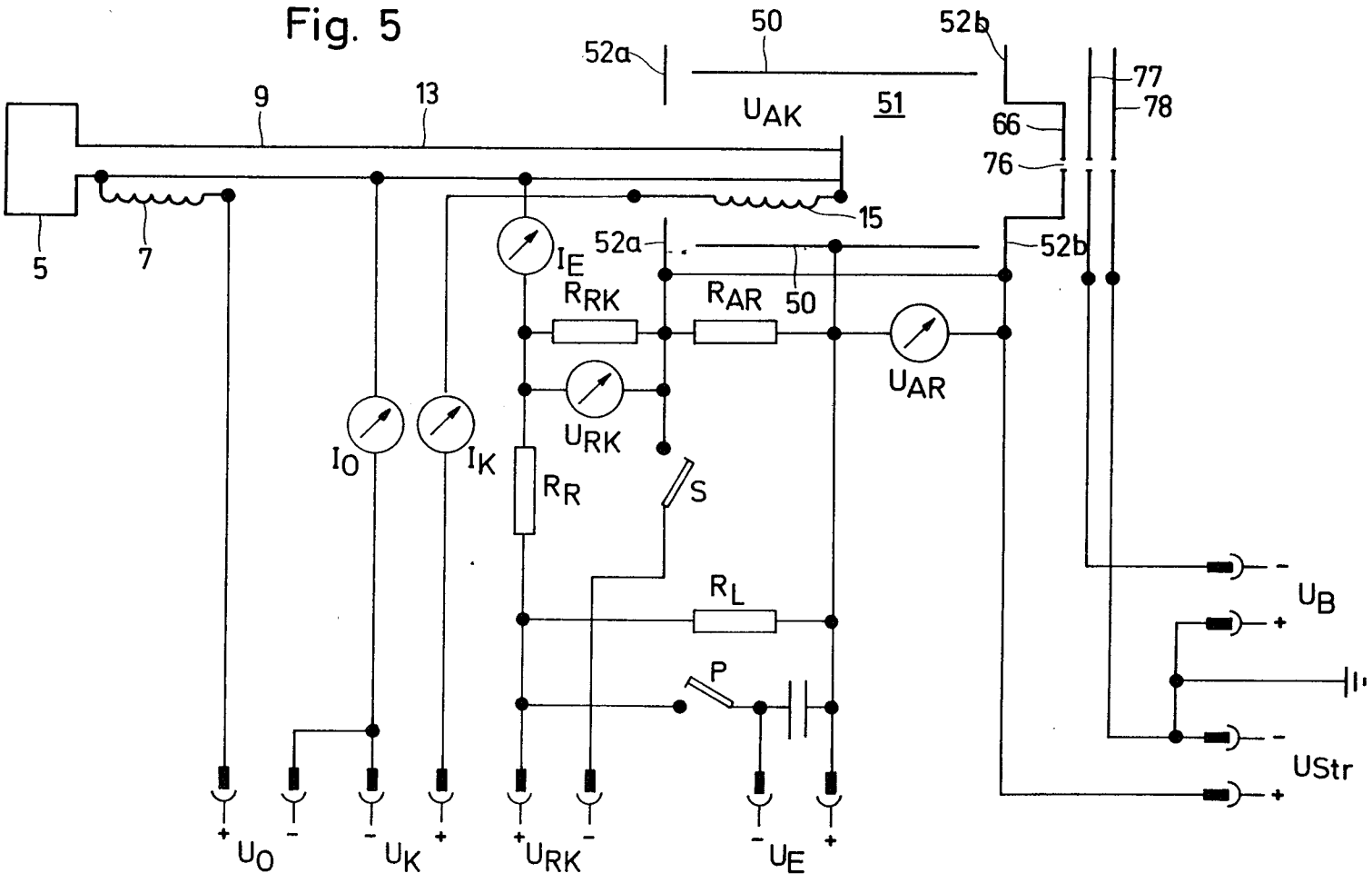
FIG. 5 is a schematic diagram showing the electrical circuit for the high current ion source.
Figure 6A:
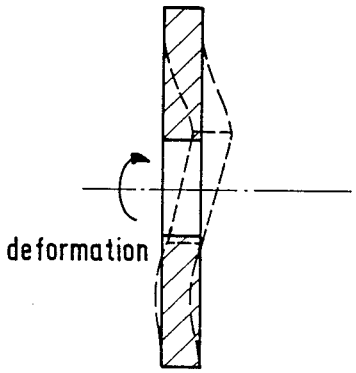
FIGS. 6*a* and 6*b* show the effect of thermal expansion on non-uniformly heated circular plates.
Figure 6B:
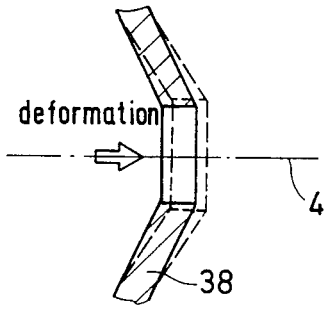

The electrical circuit for the high current ion source is shown in FIG. 5. The heating conductor 7 feeds furnace heating power $P_O$ at the furnace voltage $U_O$ into the furnace chamber 5 and the furnace temperature $T_O$ and vapor pressure $P_o$ are set. A cathode voltage $U_k$ is applied across the emitter 15 and the inner cathode conductor 13, and a reflector/cathode voltage $U_{RK}$ is applied between the electrodes 52*a*, 52*b*, which are at the same electrical potential, and the inner cathode conductor 13. A discharge voltage $U_{AK}$ is generated between the anode pipe 50 and the inner cathode conductor 13 resulting in a discharge current $I_E$.

The ion current passes through the extraction opening 76 of the source discharge electrode 66, which is maintained at a high positive potential, through the opening of the retarding field electrode 77, which is at a low negative potential, and through the opening of the associated ground electrode 78, which is at ground potential. The difference in potential between the source discharge electrode 66 and the ground electrode 78 is the beam voltage $U_{str}$, which is a measure of the beam energy, and the potential difference between the ground electrode 78 and the retarding field electrode 77 is the electron suppressing volage $U_B$.

The exiting ion beam also contains a portion $f_2$ of doubly charged ions and a portion $f_3$ of triply charged ions. At a predetermined distance from the ground electrode 78 the total ion current $I_{FC}$ can be measured with a Faraday cup.

The switch P is always closed during direct current operation. With a burning discharge, the potential of the reflector electrodes 52*a*, always near cathode potential, is self adjusting according to the internal plasma resistivity, the chosen combination of external resistors, and the position of switch S, the three modes being:

(a) $R_{AR}=1000$ ohms, $R_{RK}=\infty$ and, switch S is open, or (b) $R_{AR}=100$ ohms, $R_{RK}=10$ ohms, and switch S is open, or (c) $R_{AR}=R_{RK}=\infty$, and switch S is closed.

Only in the latter case must an external voltage $U_{RK}$ be applied; the series resistor $R_R=1$ ohm then protects the power supply against current overload.

Mode (a) facilitates the discharge ignition which is helpful with materials (generally gases) of high ionisation potential like H, He, Ne, F.

Mode (b) is generally chosen; it reduces dynamical effects during and shortly after the discharge ignition which may cause non-uniform current values. The difference between modes (a) and (b) is important for the pulsed operation only.

Mode (c) should be chosen whenever the value of the plasma potential with respect to the potential of the outlet electrode 66 is of importance for the beam formation. It is also possible to disconnect the reflector electrodes 52*a* and 52*b* electrically by using insulated bolts 67. Then electrode 52*a* would be connected according to mode (a) or (b) and electrode 52*b* to the external supply, mode (c). This hybrid mode may be beneficial for the beam formation process, resulting in higher beam brightness. The effect is indicated by computer simulations of ion beam extraction.

For the pulsed discharge mode, switch P is closed and opened periodically. It can be realized by an electronic switching unit. Resistor $R_L=100$ ohms provides a stable minimum load for the discharge circuit.

The pulsed mode is indicated when the discharge power necessary to generate the desired plasma composition is too high (more than 4 kW) for continuous operation or a pulsed ion beam is desired by the user of the source.

In a typical high current ion source constructed in accordance with FIGS. 1 and 5, the discharge was normally pulsed at 50 Hz with a 10% keying ratio. Frequencies up to 1000 Hz were also successfully applied. In this apparatus, the extraction opening 76 of the source discharge electrode 66 included seven bores each having a diameter of 2.5 mm and the spacing between the source discharge electrode 66 and the retarding field electrode 77 was set at 3.1 mm. The total ion current $I_{FC}$ was measured in a Faraday cup having a diameter of 45 mm after 1 m of free drift.

The operating parameters and measuring results are listed in the table below for the elements calcium and bismuth, the auxiliary gas (helium for calcium and xenon for bismuth) having been shut off completely.

The tested high current ion source can be operated with more than 4 kW average discharge power, up to 2.5 kW cathode heating power and about 3 kW furnace heating power.

The following chart summarizes the operation of the ion source where the symbols are defined as follows:

E1—the element constituting the ion source charge;

$I_E$—discharge current in amperes;

$U_{AK}$—discharge voltage in volts;

$P_K$—cathode power in kilowatts;

$P_0$—furnace heating power in kilowatts;

$T_0$—furnace temperature in °C.;

$P_p$—vapor pressure of the charge element in millibars, at furnace temperature $T_o$ $U_{str}$—beam voltage in kilovolts;

$f_2$—percentage of doubly charged ions in beam;

$f_3$—percentage of triply charged ions in beam;

$I_{FC}$—total ion current in milliamperes;

| $E_i$ | $I_E$ | $U_{AK}$ | $P_K$ | $P_O$ | $T_O$ | $P_p$ | $U_{str}$ | $f_2$ | $f_3$ | $I_{FC}$ |
|---|---|---|---|---|---|---|---|---|---|---|
| Ca | 200 | 50 | 1.66 | 1.40 | 840 | 2.0 | 21 | 20 | — | 6 |
| Bi | 140 | 75 | 1.23 | 2.32 | 990 | 1.6 | 31 | 28 | 6.5 | 8 |

In both examples multiply charged ions were expressively looked for. In cases where these would be harmful there can always be found discharge parameters which yield more than 99% singly charged ions.

It will be understood that the above description of the present invention is susceptible to various modifications, changes and adaptations and the same are intended to be comprehended within the meaning and range of equivalents of the appended claims.

What is claimed is:

1. A high current ion source for generating ion beams from gases and non-volatile materials, said ion source having a longitudinal axis, comprising:

a furnace-cathode unit for generating vapor to be ionized including a furnace having a chamber and at least one opening along said longitudinal axis; a major source unit containing a discharge chamber for ionizing the vapor generated in said furnace-cathode unit, said ionization being effected by primary electrons furnished by the cathode contained in said furnace-cathode unit and energized by a voltage applied between said cathode and the surrounding wall of said discharge chamber, the efficiency of said ionization being substantially enhanced by means of a magnetic field in said discharge chamber; and an extraction unit having a source outlet electrode for removing the ions from said major source unit, said furnace-cathode, major source and extraction units including connecting means coupling said furnace chamber to said discharge chamber along said longitudinal axis, said furnace chamber, discharge chamber, source outlet electrode and connecting means being heatable to a temperature above the condensation temperature of the vapor to be ionized and corresponding to the pressure of said vapor, said connecting means transporting said vapor from said furnace to said discharge chamber;

a plurality of flanges defining the periphery of said units, said flanges being located at the ends of or around each of said units and providing mutual vacuum-tight connections therebetween; and a plurality of supporting elements coupling said furnace, source discharge electrode and connecting means to corresponding ones of said plurality of flanges, said supporting elements having relatively poor heat conductivity and shapes which change as a result of thermal stresses exclusively in a direction along said longitudinal axis.

2. A high current ion source as defined in claim 1 wherein said connecting means comprises a furnace pipe extending from the opening in said furnace; a tubular inner cathode conductor having one end coupled to said furnace pipe and the other end extending into said discharge chamber; a sleeve coaxially surrounding said furnace pipe and being connected to said furnace, said sleeve having relatively high electrical and thermal conductivities; heating means enclosing said sleeve, said heating means extending along said longitudinal axis; emitter means including a plurality of wires coaxially surrounding said cathode conductor; and a bushing coupling said furnace pipe to said cathode conductor.

3. A high current ion source as defined in claim 1 wherein said flanges have cooling channels therein, and adjacent flanges have O-rings therebetween to provide vacuum-tight connections, the radii of said cooling channels being less than the radii of adjacent O-rings.

4. A high current ion source as defined in claim 1 wherein said connecting means comprises a furnace pipe extending from the opening in said furnace; a tubular inner cathode conductor having one end coupled to said furnace pipe and the other end extending into said discharge chamber; a sleeve coaxially surrounding said furnace pipe and being connected to said furnace; and a bushing coupling said furnace pipe to said cathode conductor, wherein said ion source comprises first, second and third stacks of heat shields, each stack consisting of several individual shields, said first stack being located at the end of said furnace opposite said discharge chamber, said second stack being tubular and surrounding said furnace and said third stack being tubular and surrounding said sleeve;

a bushing support plate centering said bushing, said bushing support plate being attached to one of said plurality of flanges by stud bolts, said bushing support plate and said stud bolts having relatively good electrical and thermal conductivity; and an elastic suspension connecting said furnace chamber to one of said plurality of flanges, said elastic suspension compensating for thermal changes in the length of the components comprising said furnace cathode unit.

5. A high current ion source as defined in claim 4 which further comprises an anode tube surrounding said inner cathode conductor and being coaxial therewith;

an annular reflector electrode disposed at each frontal face of said anode tube, said reflector electrodes projecting into said discharge chamber;

an anode flange having a vacuum-tight annular chamber therein which completely encloses said anode tube; and permanent magnets disposed within said annular chamber for generating a linear multipole magnetic field in said discharge chamber in order to enhance the efficiency of the ionization of said vapor, said permanent magnets being polarized in at least one of radial and tangential patterns with respect to the longitudinal axis of said ion source.

6. A high current ion source as defined in claim 1 which further comprises a circular holding disc having a central bore for receiving said source outlet electrode;

a setting ring for connecting said holding disc to a corresponding one of said plurality of flanges; and screw adjustment means for positioning said setting ring radially and axially within said extraction unit.

7. A high current ion source as defined in claim 1 wherein each of said supporting elements has a cross section which is bent at least once in the direction of said longitudinal axis.

8. A high circuit source as defined in claim 5 which further comprises first and second radial planar holding discs clamped to the ends of said anode tube;

first and second supporting rings attached to the outer edges of said first and second radial holding discs respectively and to opposite sides of said anode flange, the axial distance between the outsides of said supporting rings being less than the axial length of said anode tube.

9. A high current ion source as defined in claim 1, 2 or 4 wherein the supporting elements suspending said furnace from its corresponding flange comprise spacer bolts extending parallel to said longitudinal axis and radial bands each connecting an end of an associated bolt to said flange, the other ends of said bolts being attached to said furnace.

10. A high current ion source for generating ion beams from gases and non-volatile materials, said ion source having a longitudinal axis, comprising:

(a) a furnace-cathode unit for generating vapor to be ionized including (1) a furnace having a chamber and at least one opening along said longitudinal axis;

(2) an elongated furnace pipe extending axially from the opening in said furnace chamber;

(3) a heated sleeve surrounding said furnace pipe for heating said furnace;

(4) a bushing secured to the outside of said furnace pipe at a location spaced from the opening in said furnace chamber;

(5) an elongated cathode conductor extending axially from said bushing;

(6) first, second and third adjacent flanges electrically insulated from each other, said flanges surrounding said furnace, pipe and cathode conductor;

(7) furnace and bushing suspension means for suspending said furnace and bushing respectively from said first flange; and (8) emitter suspending means for suspending said emitter heating means from said second flange;

(b) a major source unit for ionizing the vapor generated in said furnace-cathode unit including (1) an anode pipe surrounding said cathode conductor and defining a discharge chamber therein;

(2) first and second annular reflector electrodes disposed at each end of said anode pipe, said first annular electrode being interposed between said anode pipe and said cathode conductor, said annular electrodes projecting into said discharge chamber;

(3) an anode flange having a vacuum-tight annular chamber therein surrounding said anode pipe and being located between said first and second reflector electrodes;

(4) a plurality of magnetic elements disposed within said annular chamber for generating a magnetic field in said discharge chamber;

(5) fourth and fifth flanges, said fourth flange being interposed between said third flange and said anode flange to make a vacuum-tight connection between the third flange of said furnace-cathode chamber and one side of said anode flange, and said fifth flange being secured to the opposite side of said anode flange;

(6) reflector electrode suspension means for suspending said reflector electrodes from said fourth and fifth flanges; and (7) first and second radial anode plates secured to the ends of said anode pipe and to opposite sides of said anode flange; and (c) an extraction unit for removing the ions from said major source unit including (1) a source outlet electrode having extraction openings axially secured within said discharge chamber adjacent said second reflector electrodes;

(2) a sixth flange secured to said fifth flange to make a vacuum-tight connection with the outer side of the fifth flange of said major source unit; and (3) source outlet electrode suspension means for suspending said discharge electrode from said sixth flange;

the components recited at paragraphs (a)(1) through (5)(7) and (8); (b)(1)(2)(6) and (7) and (c)(1) contacting said vapor to be ionized and being heatable to a temperature above the condensation temperature of said vapor; the components recited at paragraphs (a)(1) through (5)(b)(1) and (2) and (c)(1) being subject to a temperature determined by the vapor pressure curve of the vapor to be ionized; the suspension means recited at paragraphs (a)(7)(8), (b)(6) and (c)(3) having relatively poor heat conductivity and changing in shape along said longitudinal axis in response to thermal stresses; the power required to heat said furnace chamber, the cathode power of said inner cathode conductor and the discharge power of said discharge chamber being decoupled by said furnace pipe connecting said furnace chamber to said cathode connector.

* * * * *